US009597902B2

(12) United States Patent
Mori

(10) Patent No.: US 9,597,902 B2
(45) Date of Patent: Mar. 21, 2017

(54) PRINTER

(71) Applicants: CITIZEN HOLDINGS CO., LTD., Nishitokyo-shi, Tokyo (JP); CITIZEN SYSTEMS JAPAN CO., LTD., Nishitokyo-shi, Tokyo (JP)

(72) Inventor: Yasuyuki Mori, Nishitokyo (JP)

(73) Assignees: Citizen Watch Co., LTD., Nishitokyo, Tokyo (JP); Citizen Systems Japan Co., LTD, Nishitokyo, Tokyo (JP)

( * ) Notice: Subject to any disclaimer, the term of this patent is extended or adjusted under 35 U.S.C. 154(b) by 0 days.

(21) Appl. No.: 15/144,295

(22) Filed: May 2, 2016

(65) Prior Publication Data

US 2016/0243860 A1 Aug. 25, 2016

Related U.S. Application Data

(63) Continuation of application No. PCT/JP2014/084192, filed on Dec. 24, 2014.

(30) Foreign Application Priority Data

Mar. 31, 2014 (JP) ..... 2014-071557

(51) Int. Cl.
*B41J 2/15* (2006.01)
*B41J 13/00* (2006.01)
*B41J 15/04* (2006.01)

(52) U.S. Cl.
CPC ..... *B41J 13/0009* (2013.01); *B41J 15/042* (2013.01)

(58) Field of Classification Search
CPC . B41J 15/04; B41J 2/125; B41J 11/007; B41J 13/08
See application file for complete search history.

(56) References Cited

U.S. PATENT DOCUMENTS 7,278,719 B2 * 10/2007 Scardovi ..... B41J 2/1652 347/7
8,564,633 B2 * 10/2013 Matsushima ..... B41J 2/32 347/197
8,681,195 B2 3/2014 Matsushima

FOREIGN PATENT DOCUMENTS

JP 05-319649 A 12/1993
JP 2002-067408 A 3/2002
JP 2003-146482 A 5/2003
(Continued)

OTHER PUBLICATIONS

International Search Report issued for corresponding International Patent Application No. PCT/JP2014/084192 mailed on Mar. 24, 2015 with an English translation.

*Primary Examiner* — Lamson Nguyen
(74) *Attorney, Agent, or Firm* — Myers Wolin, LLC

(57) ABSTRACT

In a printer including a reflection type optical sensor and a transmission type optical sensor arranged to oppose each other across a paper conveyance path, a sensor spring and a plate spring are elastically deformed consequent to the wave shape of a guide unit and a guide unit, according to the positions of the reflection type optical sensor and the transmission type optical sensor along the width direction of the printer, enabling the reflection type optical sensor and the transmission type optical sensor to be moved based on the pitch of the wave shape along the width direction of the printer while transmitting a click feeling to an operator each time the sensor spring and the plate spring climb over a protruding portion of the wave shape.

6 Claims, 13 Drawing Sheets

(56) References Cited

FOREIGN PATENT DOCUMENTS

| | | | |
|---|---|---|---|
| JP | 2007-039140 | A | 2/2007 |
| JP | 2012-061698 | A | 3/2012 |
| JP | 2012-148884 | A | 8/2012 |

* cited by examiner

PRINTER

CROSS-REFERENCE TO RELATED APPLICATIONS

This is a continuation under 35 U.S.C. 120 of International Application No. PCT/JP2014/084192 filed on Dec. 24, 2014, which claims priority to Japanese Patent Application No. JP2014-071557 filed on Mar. 31, 2014, the contents of each which is incorporated by reference herein.

TECHNICAL FIELD

The present invention is related to a printer that uses a sensor separated across a paper conveyance path to detect a portion to be detected with respect to a reference position.

BACKGROUND ART

Conventional printers use a label sheet with multiple labels arranged along a longitudinal direction of a long mount and detect the positions of the labels on the mount to perform a recording operation for the labels based on a detection result. Among such printers, some can use, as a recording object, multiple types of label sheets differing in the size and shape of the labels on the mount or in the arrangement intervals between labels.

Some printers that use multiple types of label sheets as a recording object are configured such that the position of a sensor that detects the positions of labels on a mount can be moved in a direction orthogonal to the conveyance direction of the label sheet so as to detect the positions of labels corresponding to the type of label sheet used as a recording object.

For example, according to a conventional technique, a sensor is coupled via an elastic member to a guide shaft extending in a direction orthogonal to the conveyance direction of the label sheet and the position of the sensor relative to the guide shaft is fixed by friction between the elastic member and the guide shaft while the sensor is made movable along the guide shaft against the friction (see, e.g., Patent Document 1).

For example, according to another conventional technique, a paper detection unit that includes a sensor is made movable along a longitudinal direction of a long hole disposed in a guide plate, and an inner circumferential surface of the long hole is provided with a concave/convex shape formed by alternately repeating convex and concave portions while an outer surface of the paper detection unit is provided with a protruding portion so as to transmit a click feeling to an operator from engagement of the protruding portion with the concave/convex shape accompanying movement of the paper detection unit, thereby giving the operator an indication of the position at which the paper detection unit should be stopped (see, e.g., Patent Document 2).

Patent Document 1: Japanese Laid-open Patent Publication No. 2003-146482

Patent Document 2: Japanese Laid-open Patent Publication No. 2012-148884

DISCLOSURE OF INVENTION

Problem to be Solved by the Invention

Nonetheless, for example, if the position of the sensor is fixed by friction between the sensor and the guide shaft and the sensor is moved against the friction between the sensor and the guide shaft as in the conventional technique described in Patent Document 1, it is difficult to finely adjust the position of the sensor. Therefore, for example, if a light-emitting element and a light-receiving element in the sensor are configured to move independently, it is difficult to align the positions of the elements.

The same applies to the conventional technique described in Patent Document 2 and, although an operator can be given an indication of the position at which the paper detection unit should be stopped, if the light-emitting element and the light-receiving element in the sensor are configured to move independently, it is difficult to align the positions of the elements.

To solve the problems associated with the conventional techniques, one object of the present invention is to provide a printer that can easily and accurately align the positions in the movement direction of sensor elements formed as separate bodies in a sensor moveable in a predetermined direction.

Means for Solving Problem

To solve the problems above and achieve an object, a printer according to the present invention includes a paper path that guides paper used as a recording object through a predetermined path; a conveyance mechanism that in a predetermined direction, conveys the paper guided through the paper path; a sensor that includes a pair of sensor elements arranged to oppose each other across the paper path and to be movable along an orthogonal direction orthogonal to a direction of conveyance of the paper by the conveyance mechanism; and a recording unit disposed on the paper path to perform a recording operation with respect the paper conveyed through the paper path by the conveyance mechanism, based on a result of detection by the sensor. The printer is further characterized in that the sensor elements in the sensor are respectively interlinked with a guide unit via an elastic member biased in a direction of coming into contact with the guide unit that forms a wave shape along the orthogonal direction and is formed on a frame supporting the conveyance mechanism and the recording unit, the elastic member elastically deforming according to the wave shape of the guide unit; the sensor elements are disposed to be moveable along the guide unit by elastic deformation of the elastic member according to position along the orthogonal direction; and the guide unit corresponding to one sensor element of the sensor and the guide unit corresponding to the other sensor element of the sensor respectively form the wave shape protruding and receding at same positions along the orthogonal direction.

The printer according to the present invention is further characterized in that in the invention above, the frame is formed by sheet-metal working of a metal plate-shaped member, and the guide unit is formed integrally with the frame.

The printer according to the present invention is further characterized in that in the invention above, the elastic member is a plate spring having a protruding portion forming substantially a same shape as a receding portion of the wave shape.

The printer according to the present invention is further characterized in that in the invention above, the elastic member is a wire spring formed of a wire-like member having a diameter dimension that is smaller than a dimension of an opening width of a receding portion in the wave shape.

Effect of the Invention

The printer according to the present invention achieves an effect in that the positions in the movement direction of the sensor elements formed as separate bodies in a sensor movable in a predetermined direction can be aligned easily and accurately.

BEST MODE(S) FOR CARRYING OUT THE INVENTION

A preferred embodiment of a printer according to the present invention will be described in detail with reference to the accompanying drawings.

Figure 1:
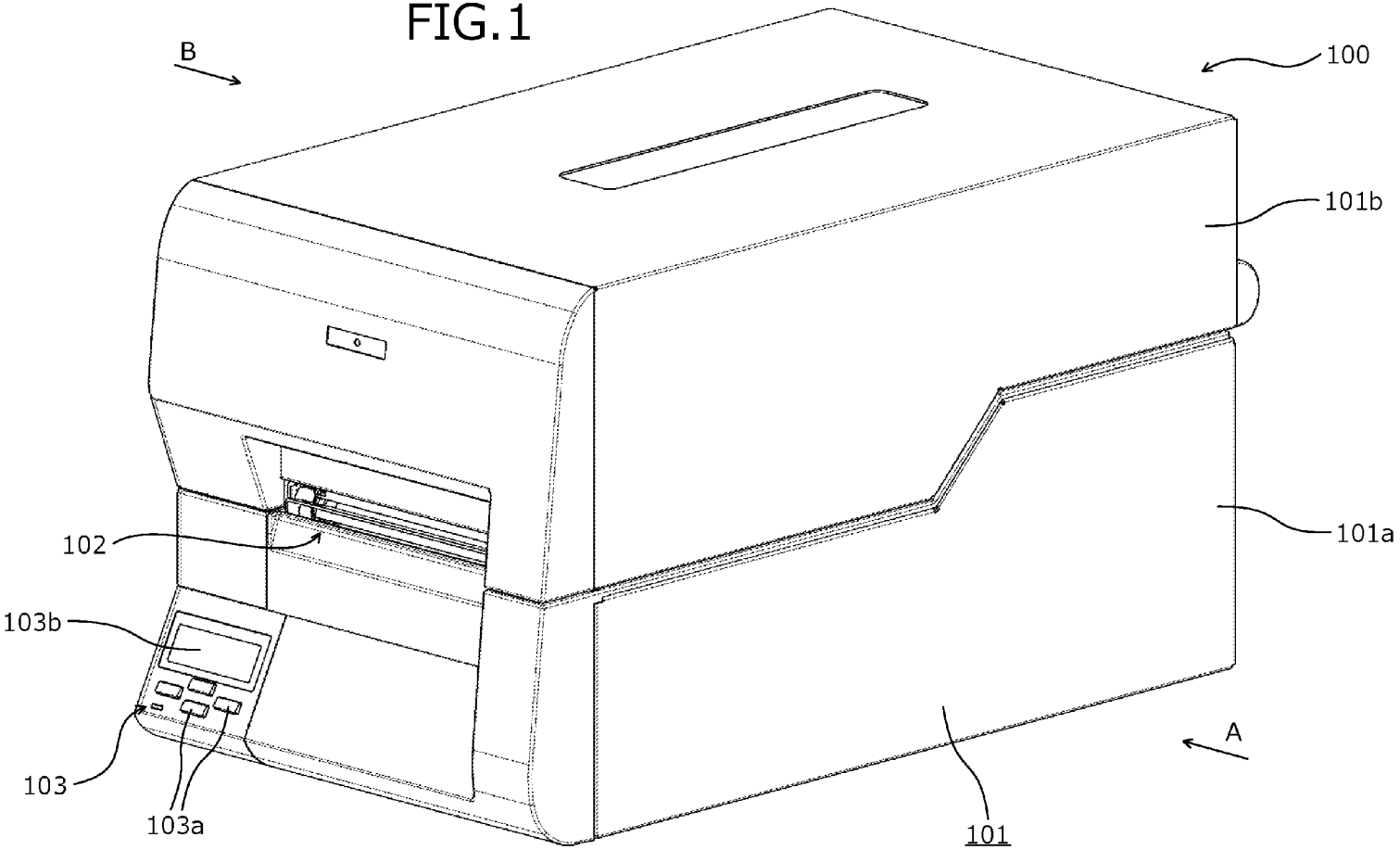
FIG. 1 is an explanatory view of an exterior of a printer of an embodiment according to the present invention.

A configuration of a printer of an embodiment according to the present invention will be described. FIG. 1 is an explanatory view of an exterior of the printer of the embodiment according to the present invention. FIG. 1 depicts the printer of the embodiment according to the present invention in an installed state, viewed obliquely from above.

In FIG. 1, a printer 100 of the embodiment according to the present invention includes a housing 101 forming a hollow parallelepiped shape. The housing 101 includes a lower housing 101*a* having an opening in an upper aspect and forming a substantially box shape, and an upper housing 101*b* closing the opening of the lower housing 101*a* in an openable manner.

The upper housing 101*b* has an opening in a lower aspect and closes the opening of the lower housing 101*a* with the opening of the upper housing opposing the opening of the lower housing 101*a*. The upper housing 101*b* is supported about an axis by the lower housing 101*a*, at a rear aspect of the printer 100 (on the right side of FIG. 1) and is thereby rotatably coupled to the lower housing 101*a*.

With the opening of the lower housing 101*a* closed by the upper housing 101*b*, the housing 101 forms a housing space that houses a printer main body (see FIGS. 4 and 5) inside the upper housing 101*b* and the lower housing 101*a*. With the opening of the lower housing 101*a* closed by the upper housing 101*b*, the housing 101 forms a discharge port 102 that discharges a recorded recording medium in a front surface (on the left side of FIG. 1) of the housing 101. The discharge port 102 is formed in a boundary portion between the upper housing 101*b* and the lower housing 101*a*.

On an outer surface of the housing 101, the front surface of the housing 101 (the lower housing 101*a*) is equipped with an operation panel 103. The operation panel 103 includes buttons 103*a* that receive various input operations and a display panel 103*b* that displays a state, etc. of the printer 100.

The display panel 103*b* displays a given message to report the state of the printer 100 such as when the printer is powered on and put into a print stand-by state, an error occurs in the printer 100, or the remaining amount of paper held by the printer 100 becomes less than or equal to a predetermined amount. The display panel 103*b* can be realized by a liquid crystal display, for example.

Figure 2:
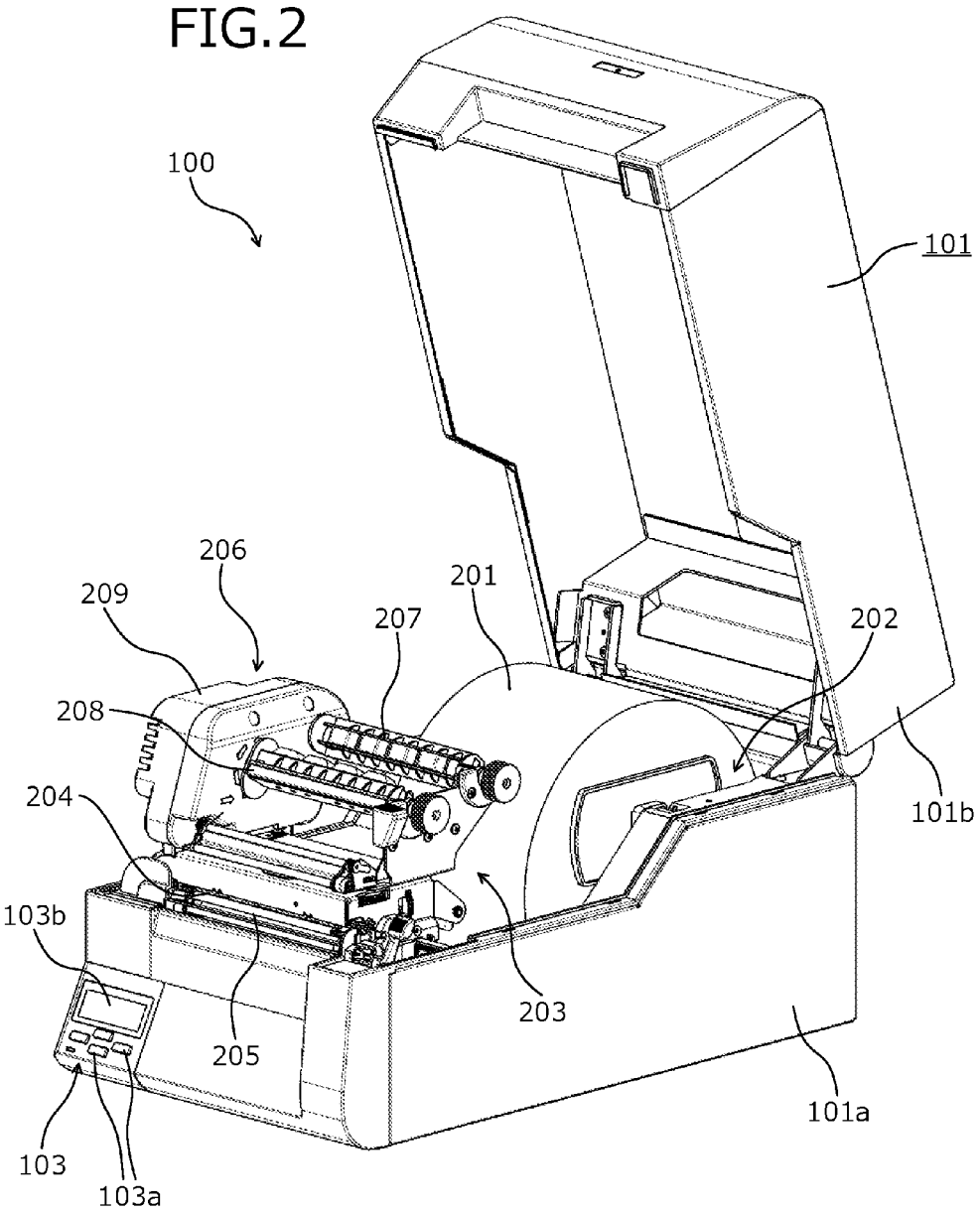
FIG. 2 is an explanatory view (part 1) of the printer with a housing opened.
Figure 3:
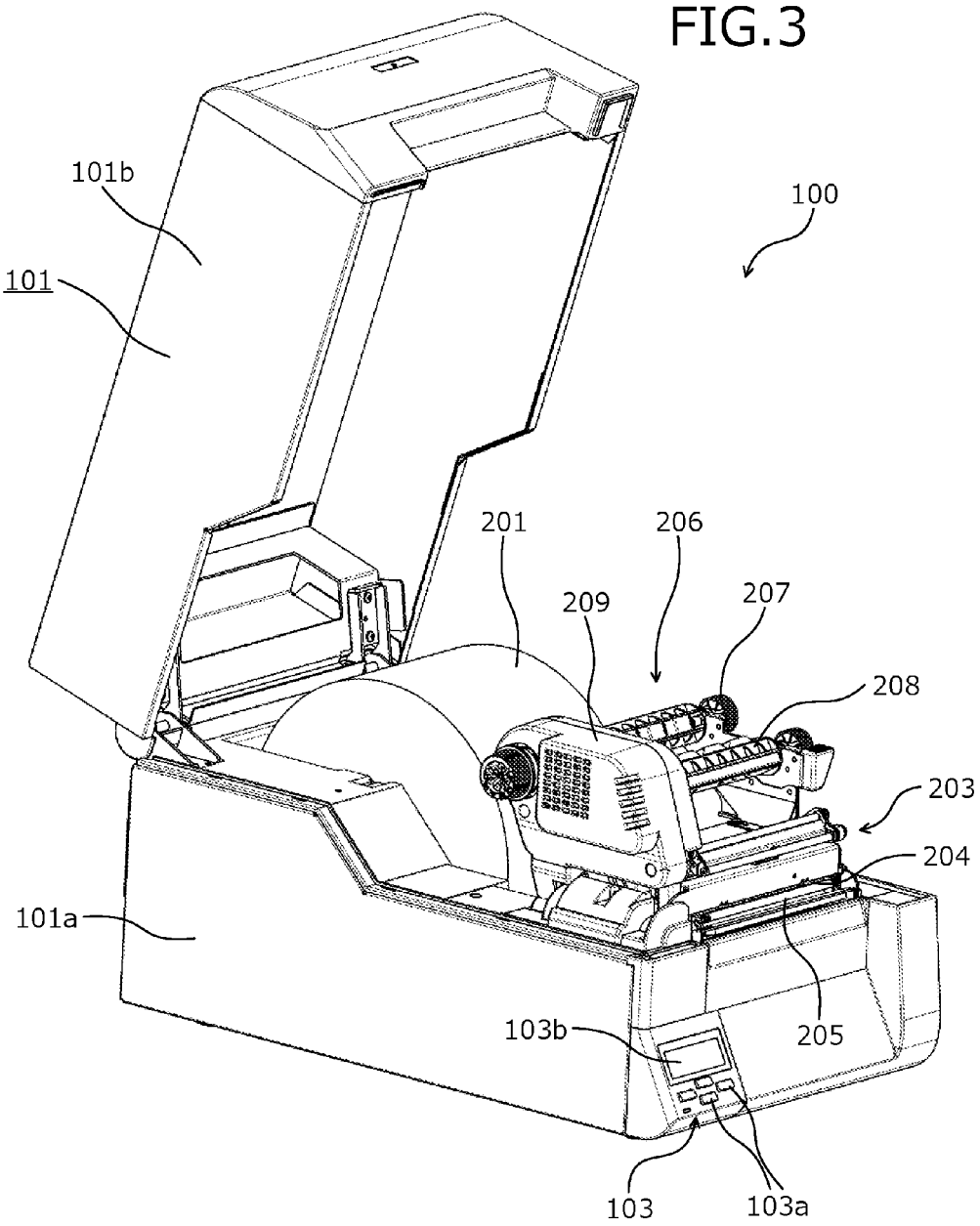
FIG. 3 is an explanatory view (part 2) of the printer with the housing opened.

FIGS. 2 and 3 are explanatory views of the printer 100 with the housing 101 opened. FIG. 2 depicts the printer 100 with the inside of the housing 101 opened exteriorly, as viewed from a position located on the upper right side with respect to the front surface of the printer 100. FIG. 3 depicts the printer 100 as viewed from a position located on the upper left side with respect to the front surface of the printer 100.

In FIGS. 2 and 3, the printer 100 includes a paper holding unit 202 that, at a rear aspect in the housing 110, holds a recording medium (paper) 201 that is used as a recording object and wound into a roll shape. The recording medium (paper) 201 used as a recording object can be a label sheet with multiple labels arranged along a longitudinal direction of a mount wound into a roll shape.

The printer 100 includes a head unit 203 disposed closer to the front surface as compared to the paper holding unit 202 in the housing 101. A conveyance path is formed inside the housing 101 from the paper holding unit 202 via the head unit 203 to the discharge port 102. At the time of a recording operation in the printer 100, the paper 201 wound into a roll shape held by the paper holding unit 202 is pulled out from a longitudinal end portion on the outer circumference and conveyed via the head unit 203 to the discharge port 102.

The head unit 203 includes a print head 204. The print head 204 performs a thermal type recording operation, for example. The print head 204 that performs a thermal type recording operation includes multiple heating elements arranged in a line along a width direction of the printer 100 (along a direction orthogonal to the conveyance direction of the paper 201).

The printer 100 selectively energizes the heating elements in the thermal head to selectively cause the heating elements to generate heat and thereby performs the recording operation. The head unit 203 may include the print head 204 of another type of recording instead of the thermal type recording.

In the housing 101, a platen 205 is disposed facing the print head 204 across the conveyance path (the paper 201 being conveyed through the conveyance path). The platen 205 forms a substantially columnar shape having an axial direction that is along the width direction of the printer 100. At the time of the recording operation, the platen 205 supports a rear surface of the paper 201 while a pushing force is applied to a front surface (a recording surface) by the print head 204. The print head 204 is biased in a direction toward the platen 205.

To one end of an axis of the platen 205, a motor (see reference numeral 507 of FIG. 5) is attached via a gear train not depicted. The gear train rotates by transmitting a drive force of the motor. The platen 205 rotates accompanying the rotation of gears making up the gear train. The platen 205 rotates and thereby, conveys the paper 201 in the conveyance path, from the paper holding unit 202 side toward the discharge port 102.

The head unit 203 includes a ribbon unit 206 supporting an ink ribbon not depicted. The ribbon unit 206 includes a ribbon support shaft 207 supporting the ink ribbon before the ink ribbon is provided for a recording operation and a ribbon winding shaft 208 winding the ink ribbon after a recording operation. The ribbon unit 206 also includes a ribbon shaft drive mechanism that rotates the ribbon winding shaft 208 to feed the ink ribbon supported by the ribbon support shaft 207 and wind the fed ink ribbon around the ribbon winding shaft 208. The ribbon shaft drive mechanism is housed in a case 209 and is made up of a motor (see reference numeral 405 of FIG. 5), a wheel train that transmits the drive force of the motor to the ribbon winding shaft 208, a ribbon board that drives the motor, etc.

Figure 4:
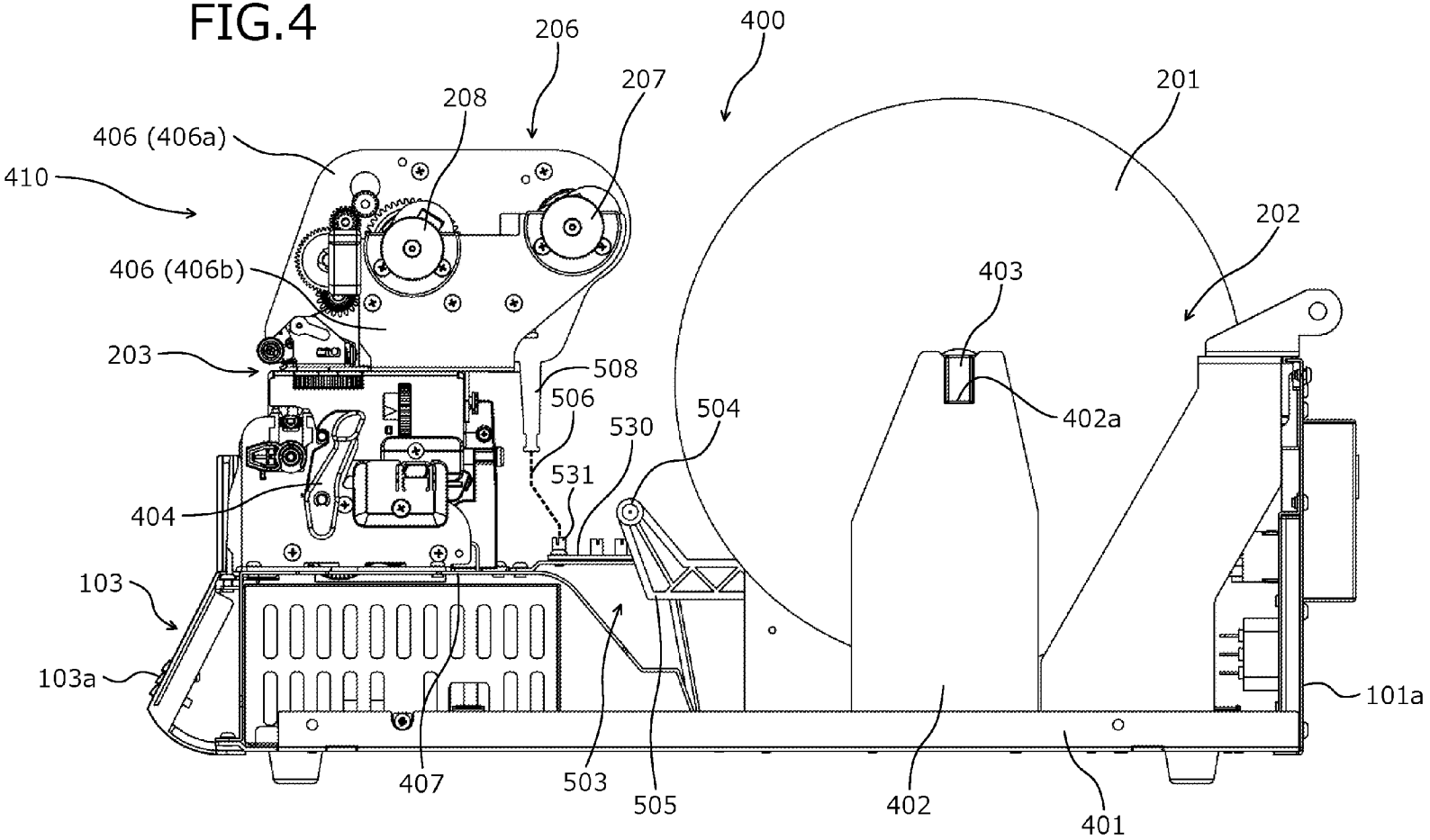
FIG. 4 is a side view (part 1) of a head unit and a printer main body.
Figure 5:
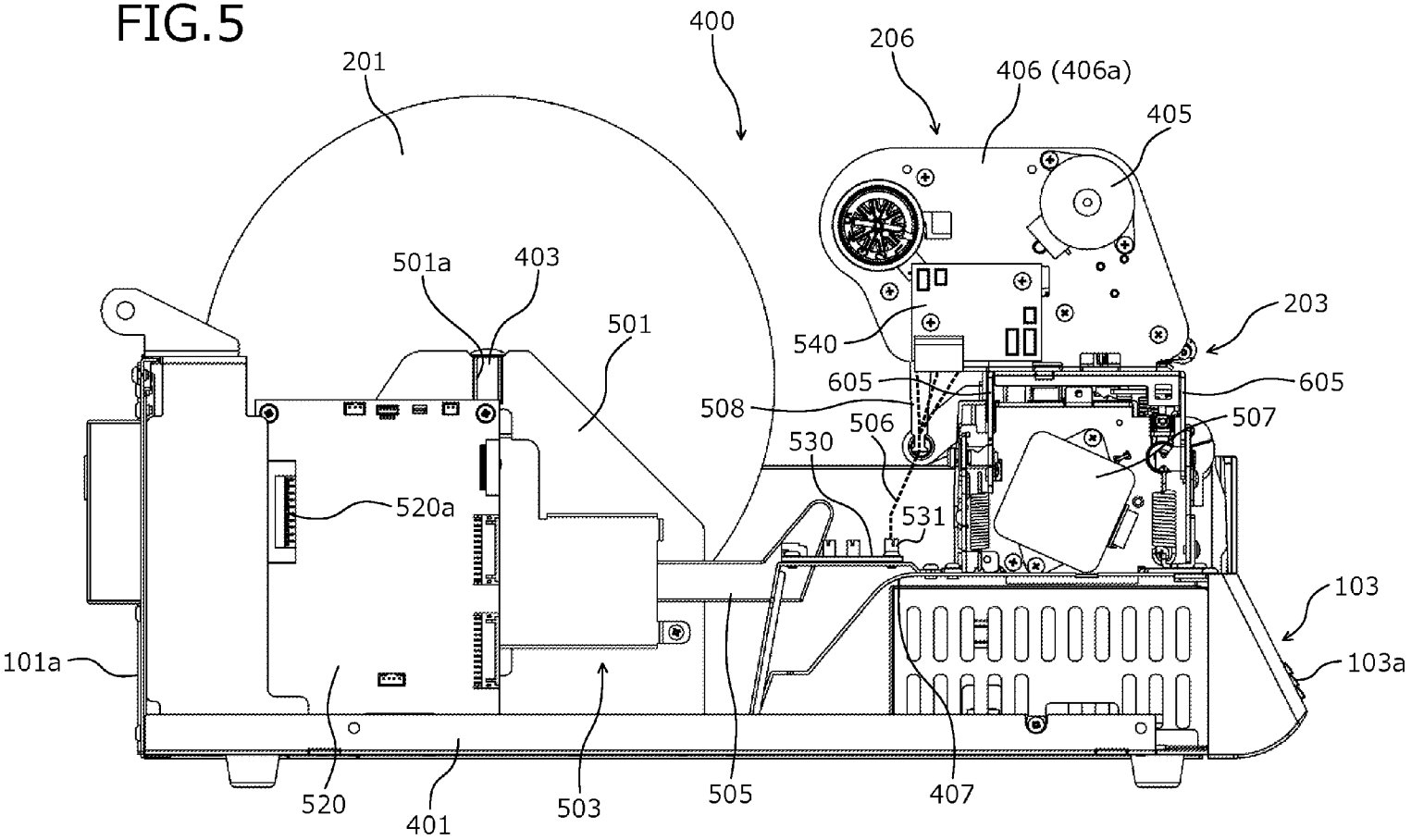
FIG. 5 is a side view (part 2) of the head unit and the printer main body.

FIGS. 4 and 5 are side views of the head unit 203 and the printer main body. FIG. 4 depicts the printer main body with the housing 101 removed as viewed in the direction indicated by arrow A in FIG. 1. FIG. 5 depicts the printer main body with the housing 101 removed viewed in the direction indicated by arrow B in FIG. 1. FIGS. 4 and 5 depict a state in which the case 209 is removed in the ribbon unit 206.

In FIGS. 4 and 5, the printer main body 400 includes a bottom frame 401 disposed in the housing 101. The bottom frame 401 is formed by sheet-metal working of a metal plate-shaped member having a predetermined thickness. A pair of shaft paper guides 402, 501 realizing a pair of frames is disposed in the bottom frame 401.

The pair of the shaft paper guides 402, 501 is disposed at the position of the paper holding unit 202 in the housing 101. The pair of the shaft paper guides 402, 501 is disposed such that the shaft paper guides 402, 501 oppose each other along the width direction of the printer 100. When the paper holding unit 202 holds the paper 201 that is wound into a roll shape, the pair of the shaft paper guides 402, 501 is disposed such that the shaft paper guides 402, 501 oppose each other across the paper 201, which is wound into a roll shape.

Cutout portions 402*a*, 501*a* are disposed respectively in upper ends of the pair of the shaft paper guides 402, 501. The cutout portions 402*a*, 501*a* form a rectangular shape opened on the upper side (a portion on the upper side in FIGS. 4 and 5). The cutout portions 402*a*, 501*a* support a shaft 403 that holds the paper 201 that is wound into a roll shape and housed in the paper holding unit 202, the paper 201 being held such that the paper 201 can be pulled out from the paper holding unit 202.

The shaft 403 can be realized by a rod-like member having a cross section forming a polygonal shape (e.g., a quadrangular shape). The shaft 403 is formed by using an insulating material such as a plastic material, for example. The cutout portions 402*a*, 501*a* are formed by partially cutting out the upper end portions of the pair of the shaft paper guides 402, 501 in a size and shape substantially identical to the outer shape of the cross section of the shaft 403.

The ends of the shaft 403 are respectively fitted into the cutout portions 402*a*, 501*a* disposed respectively in the pair of the shaft paper guides 402, 501, whereby the shaft 403 is supported by the pair of the shaft paper guides 402, 501. The shaft 403 is attached to the paper holding unit 202 in a detachable manner. The shaft 403 is removed from the paper holding unit 202 such as when the paper 201 is replaced.

The paper holding unit 202 supports the shaft 403 with the pair of the shaft paper guides 402, 501, the shaft 403 being inserted inside a winding core of the paper 201 wound into a roll shape. Thereby, the paper holding unit 202 holds the paper 201, which is long and wound into a roll shape, such that the paper 201 can be pulled out from the longitudinal end portion on the outer circumference. The shaft 403 is inserted inside the winding core without being fixed to the winding core and therefore, supports the winding core of the paper 201, enabling rotation around the shaft 403. Thus, rotation of the winding core of the paper 201 around the shaft 403 enables the paper 201 housed in the paper holding unit 202 to be pulled out from the longitudinal end portion on the outer circumference.

The shaft paper guides 402, 501 are respectively formed by sheet-metal working of a metal plate-shaped member having a predetermined thickness. Forming the shaft paper guides 402, 501 respectively from a metal plate-shaped member having a predetermined thickness enables the both ends of the shaft 403 inserted inside the winding core of the paper 201 to be safely and assuredly supported even when the paper 201 wound into a roll shape is roll paper having a large diameter and large weight.

The shaft paper guide 501 of the pair of the shaft paper guides 402, 501 is equipped with a damper mechanism 503. The damper mechanism 503 includes a damper shaft 504 swingable in contacting and separating directions with respect to the paper 201 in the conveyance path. The damper shaft 504 is positioned between the paper holding unit 202 and the head unit 203 in the conveyance path.

The damper shaft 504 forms a rod shape having a circular cross section and an axial direction that is the width direction of the printer 100. One end of the damper shaft 504 is attached to a tip of a damper arm 505. The damper arm 505 is disposed rotatably in a plane formed by the shaft paper guide 501, by using one end coupled to the shaft paper guide 501 as a fulcrum. The damper arm 505 rotates by using the one end as a fulcrum, thereby swinging the damper shaft 504 disposed at the other end in the contacting and separating directions with respect to the paper 201 in the conveyance path.

The damper mechanism 503 includes a biasing member (not depicted) biasing the damper arm 505 in a direction of bringing the damper shaft 504 into contact with the paper 201. The biasing member can be realized by a first spring and a second spring (both not shown), for example.

The first spring can be realized by a compression coil spring that compresses the damper shaft 504 from the upper side to the lower side in FIG. 5. When the damper arm 505 rotates from the lower side to the upper side, the first spring biases the damper arm 505 from the upper side to the lower side.

The second spring can be realized by a compression coil spring that compresses the damper shaft 504 from the lower side to the upper side in FIG. 5. When the damper arm 505 rotates from the upper side to the lower side, the second spring biases the damper arm 505 from the lower side to the upper side.

When the paper 201 held by the paper holding unit 202 is so-called outward roll paper having a recording surface that is a surface on the outer circumferential side when the paper is wound into a roll shape, the paper 201 is guided through the conveyance path such that the damper shaft 504 is brought into contact with the paper 201 from the lower side in FIGS. 4 and 5. When the paper 201 held by the paper holding unit 202 is so-called inward roll paper having a recording surface that is a surface on the inner circumferential side when the paper is wound into a roll shape, the paper 201 is guided through the conveyance path such that the damper shaft 504 is brought into contact with the paper 201 from the upper side in FIGS. 4 and 5. The paper 201 is guided through the conveyance path to come into contact with the damper shaft 504 between the paper holding unit 202 and the head unit 203 and to be bent at the position of the contact.

When a recording operation is started and a conveyance force of the platen 205 is applied to the paper 201 in a state in which no recording operation is performed, the paper 201 is pulled in a stretched manner between the platen 205 and the paper holding unit 202 by an inertia force due to the weight of the paper 201 wound into a roll shape in the paper holding unit 202. In particular, since the conveyance force of the platen 205 is applied to the paper 201 while the inertia force tending to maintain a stopped state is acting due to the weight of the paper 201 wound into a roll shape in the paper holding unit 202, a conveyance force toward the discharge port 102 is momentarily applied to the paper 201 on the side closer to the platen 205 even though the paper 201 is stopped on the side of the paper holding unit 202. As a result, the paper 201 is pulled in a linearly stretched manner between the platen 205 and the paper holding unit 202.

Since the damper mechanism 503 includes the biasing member that biases the damper arm 505 in the direction of bringing the damper shaft 504 into contact with the paper 201, when the paper 201 is pulled in a linearly stretched manner, the damper mechanism 503 causes the damper shaft 504 to resiliently contact the paper 201 and bias the paper 201 in a bending direction. As a result, since the stretching of the paper 201 can be buffered to alleviate impact (inertia force) on the paper 201, the paper 201 can be conveyed with precision and a constant feed rate of the paper 201 can be achieved regardless of whether the paper 201 is outward roll paper or inward roll paper.

The ribbon unit 206 includes a pair of ribbon frames 406 (406*a*, 406*b*) supporting the ribbon support shaft 207 and the ribbon winding shaft 208. The ribbon frames 406 (406*a*, 406*b*) support the ribbon support shaft 207 and the ribbon winding shaft 208 at both axial end positions of the ribbon support shaft 207 and the ribbon winding shaft 208 such that the ribbon support shaft 207 and the ribbon winding shaft 208 are rotatable around axial centers. The ribbon frame 406*a* among the ribbon frames 406 is equipped with the motor 405 that rotates the ribbon winding shaft 208.

The printer main body 400 includes electrical system components providing drive control to the units included in the printer 100. The electrical system components include a control board 520, a power source board (not depicted), an interface board (not depicted), a relay board 530, a ribbon board 540, and various cables.

The control board 520 is disposed in a standing manner and is fixed to a bracket (not depicted) that is fixed to the bottom frame 401 outside the shaft paper guide 501. The control board 520 includes a CPU, memory, etc. providing energization control of the print head 204, drive control of the motor 507 that drives the platen 205, drive control of a motor that drives the ribbon support shaft 207 and the ribbon winding shaft 208, etc.

The power source board is connected to the control board 520. The power source board is located under the head unit 203. The power source board is connected to the control board 520 via a cable (not depicted) that is connected to a connector (not depicted) included in the power source board. The power source board provides a power source to the control board 520 via the cable connecting between the power source board and the control board 520.

The interface board is connected to the control board 520 via a connector 520*a*. The interface board includes an interface connector (not depicted) that is connected to an external device. The interface connector is attached via an opening (not depicted) disposed in the lower housing 101*a* such that the interface connector is exposed externally, from a rear aspect of the lower housing 101*a*.

The relay board 530 is disposed on a left side portion between the head unit 203 and the paper holding unit 202. The relay board 530 is fixed onto a bracket 407 that is fixed to the bottom frame 401. The relay board 530 is connected to the control board 520 via a cable not depicted.

The ribbon board 540 is attached to the ribbon frame 406*a*. The ribbon board 540 is connected to the motor 405 that drives the ribbon support shaft 207 and the ribbon winding shaft 208 as well as a ribbon rotation detection sensor and a ribbon tension sensor (both not depicted). The ribbon board 540 is connected via a cable 506 to a connector 531 of the relay board 530.

The cable 506 is fixed to a cable supporting member 508 disposed on the ribbon frame 406*a* between the relay board 530 and the ribbon board 540. The cable supporting member 508 is disposed projecting from the lower end of the ribbon frame 406*a* to a position on a rotation center axis of the head unit 203 relative to the printer main body 400 or in the vicinity of the rotation center axis.

By fixing the cable 506 to a position on the rotation center axis of the head unit 203 relative to the printer main body 400 or in the vicinity of the rotation center axis, the cable 506 can be restrained from being damaged because of pulling and rubbing due to the rotation of the head unit 203. The cable supporting member 508 may be used for fixing not only the cable 506 but also other cables supplying electricity and outputting control signals to the print head 204 included in the head unit 203 and various sensors such as a sensor detecting a position of the paper 201.

The ribbon board 540 receives the power source supplied from the control board 520 and the control signals output from the control board 520 via the relay board 530 and is thereby driven by the control board 520.

The head unit 203 is rotatably coupled to the printer main body 400 via a shaft (not depicted) having an axial direction that is a direction parallel to the conveyance direction of the paper 201 conveyed through the conveyance path (the longitudinal direction of the paper 201). The printer main body 400 is equipped with a lock mechanism (not depicted) locking the head unit 203 such that the head unit 203 is fixed to the printer main body 400. The printer main body 400 is equipped with a lock release lever 404 that releases the locking of the lock mechanism. The lock release lever 404 is rotatably coupled to the printer main body 400.

The lock release lever 404 is biased from the rear toward the front of the printer 100 and is positioned at an anterior aspect to lock the head unit 203 in a fixed state to the printer main body 400. The locking of the lock mechanism is released by rotating the lock release lever 404 in a direction from the front toward the back of the printer 100. Manipulation of the printer main body 400, the head unit 203, and the lock release lever 404 are enabled in the printer 100 when the upper housing 101*b* is rotated relative to the lower housing 101*a* to open the housing space exteriorly.

Figure 6:
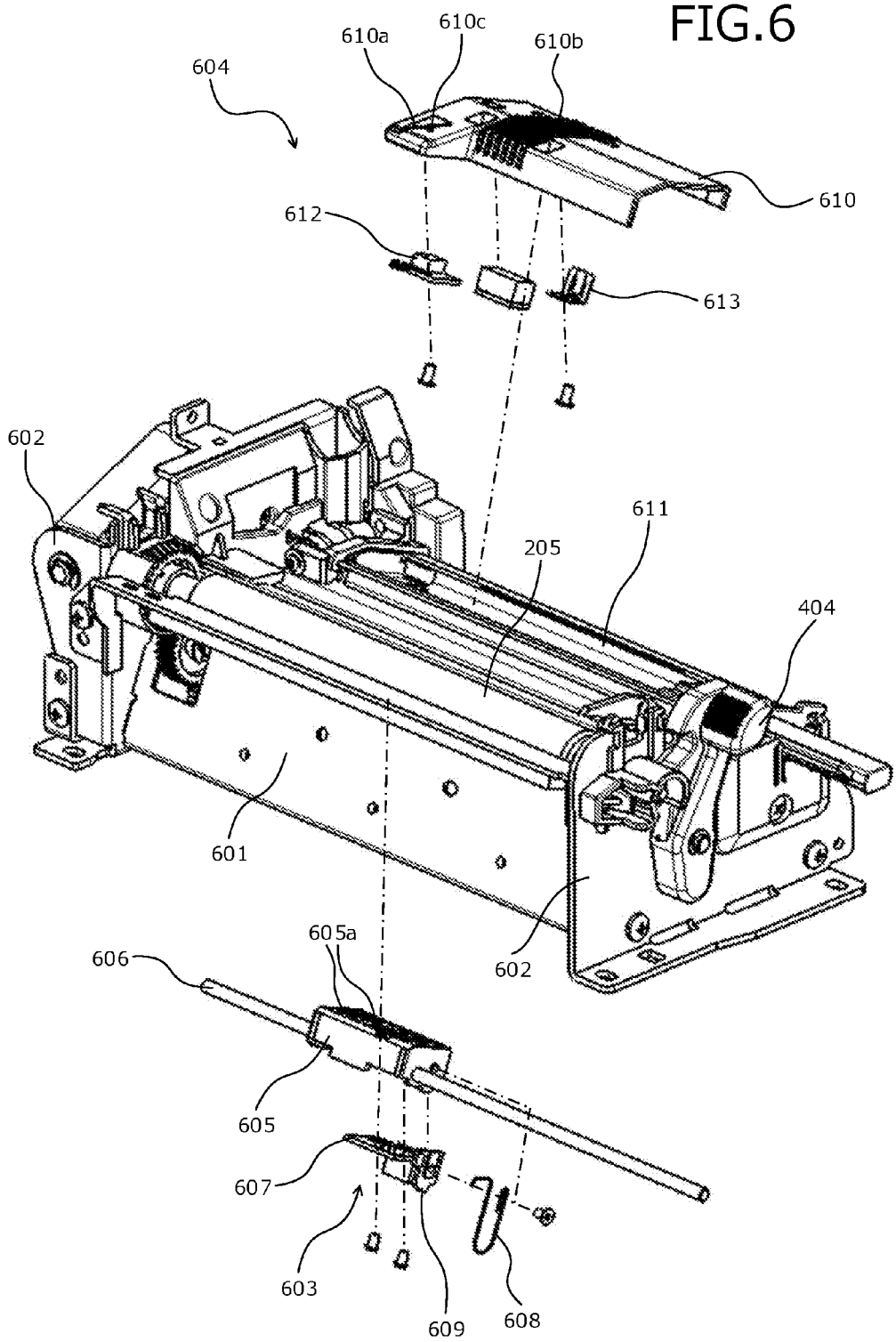
FIG. 6 is an exploded perspective view of a printing mechanism unit.
Figure 7:
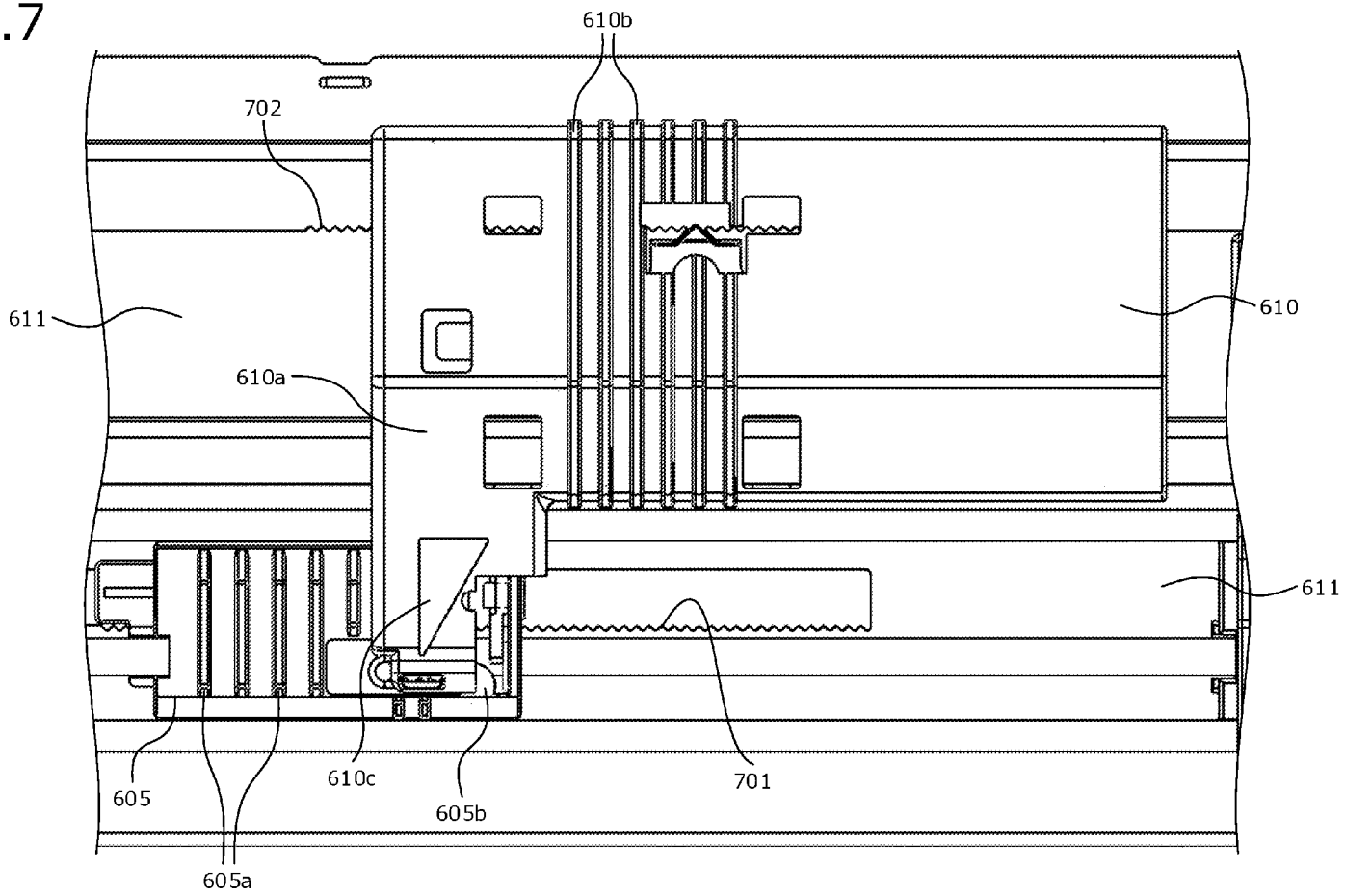
FIG. 7 is a plane view of a portion of the printing mechanism unit.
Figure 8:
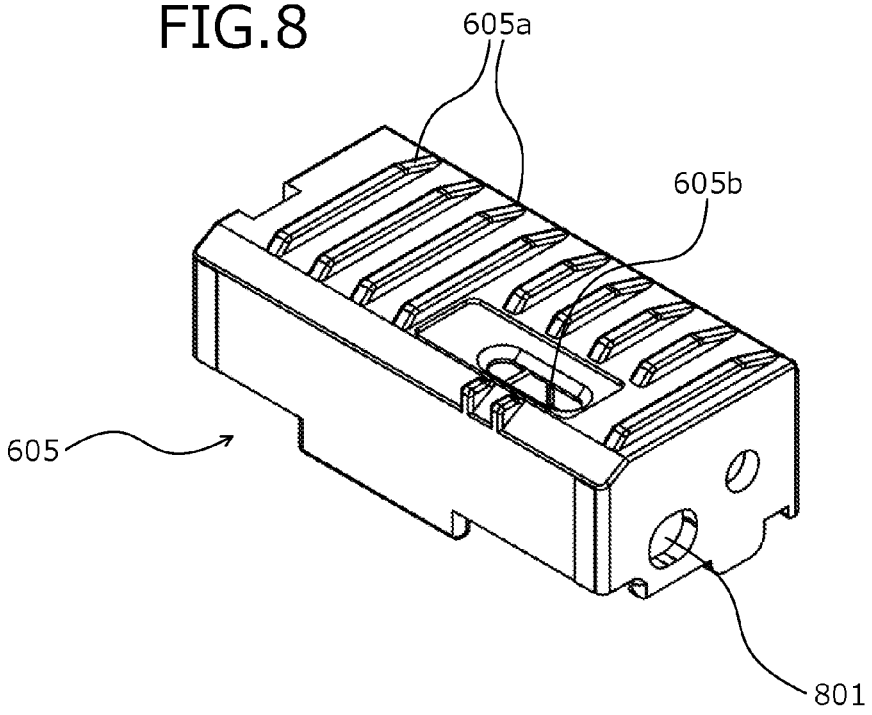
FIG. 8 is an explanatory view (part 1) of units making up the printing mechanism unit.
Figure 9:
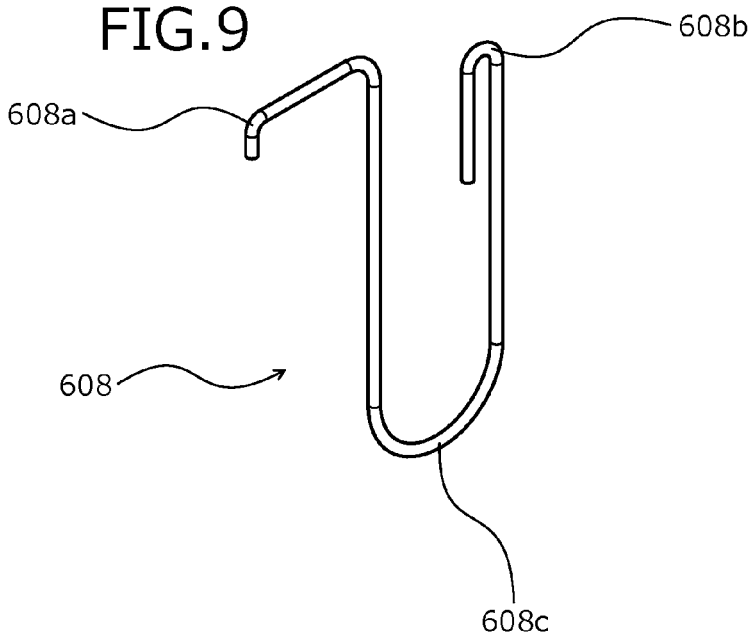
FIG. 9 is an explanatory view (part 2) of units making up the printing mechanism unit.

FIG. 6 is an exploded perspective view of a printing mechanism unit 410. FIG. 7 is a plane view of a portion of the printing mechanism unit 410. FIGS. 8, 9, 10, 11, 12, 13, 14, 15, and 16 are explanatory views of units making up the printing mechanism unit 410. FIG. 6 depicts a partially exploded view of the printing mechanism unit 410 in the printer 100 as viewed obliquely from the front and above. FIG. 7 depicts the printing mechanism unit 410 viewed from above with respect to the view depicted in FIG. 6.

As depicted in FIGS. 6, 7, 8, 9, 10, 11, 12, 13, 14, 15, and 16, the printing mechanism unit 410 includes a pair of side frames 602 coupled via a main frame 601. The pair of the side frames 602 is arranged along the width direction of the printer 100 such that the side frames 602 oppose each other. A lower sensor unit 603 and an upper sensor unit 604 are disposed between the pair of the side frames 602.

The lower sensor unit 603 includes a lower sensor holder 605 and a sensor shaft 606. The lower sensor holder 605 forms a substantially box shape with a lower aspect opened (see FIG. 8) and holds a reflection type optical sensor 607 inside. The upper surface of the lower sensor holder 605 is a paper passing surface over which the paper 201 passes, and is provided with multiple ribs 605*a* having a longitudinal direction that is the conveyance direction of the paper 201 to reduce the resistance of paper conveyance and to provide finger hooks when the lower sensor holder 605 is moved along the axial direction of the sensor shaft 606.

The reflection type optical sensor 607 includes a light-emitting element that emits light toward the upper sensor unit 604 and a light-receiving unit that receives the light emitted from the light-emitting element and reflected by the paper 201, etc. conveyed through the conveyance path (both not depicted). The reflection type optical sensor 607 can be easily implemented using a known technology and therefore, will not be described. The lower sensor holder 605 is provided with an opening 605*b* that allows the light emitted by the light-emitting element to exit to the outside of the lower sensor holder 605 and guides the light reflected by the paper 201, etc. to the inside of the lower sensor holder 605.

The sensor shaft 606 forms a rod shape having a circular cross section and an axial direction that is the width direction of the printer 100. The lower sensor holder 605 and the sensor shaft 606 are coupled by the sensor shaft 606 penetrating a through-hole 801 that penetrates the lower sensor holder 605 along the axial direction of the sensor shaft 606. The lower sensor holder 605 is made slidable relative to the sensor shaft 606, along the axial direction of the sensor shaft 606.

The lower sensor unit 603 includes a sensor spring 608 implementing an elastic member. The sensor spring 608 is implemented by a wire spring formed of a wire-like member having a predetermined diameter dimension (see FIG. 9). The sensor spring 608 is attached to the lower sensor holder 605 such that an end bent into a rectangular shape and the other end are inserted in the lower sensor holder 605.

The sensor spring 608 is bent into a substantially U-shape between one end side 608*a* and the other end side 608*b*, which are inserted into the lower sensor holder 605 with this U-shaped portion 608*c* biased in the bending direction. As a result, the sensor spring 608 is biased by the elastic force thereof in the direction of coming into contact with a guide unit 701 (see FIG. 7) disposed on the main frame 601.

Figure 10:
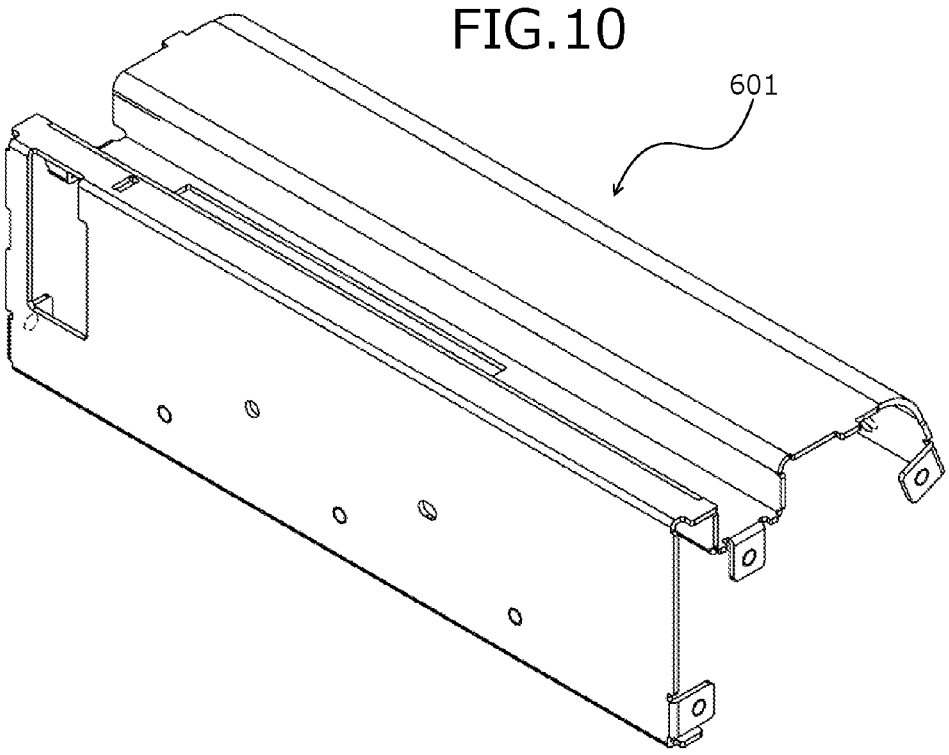
FIG. 10 is an explanatory view (part 3) of units making up the printing mechanism unit.
Figure 11:
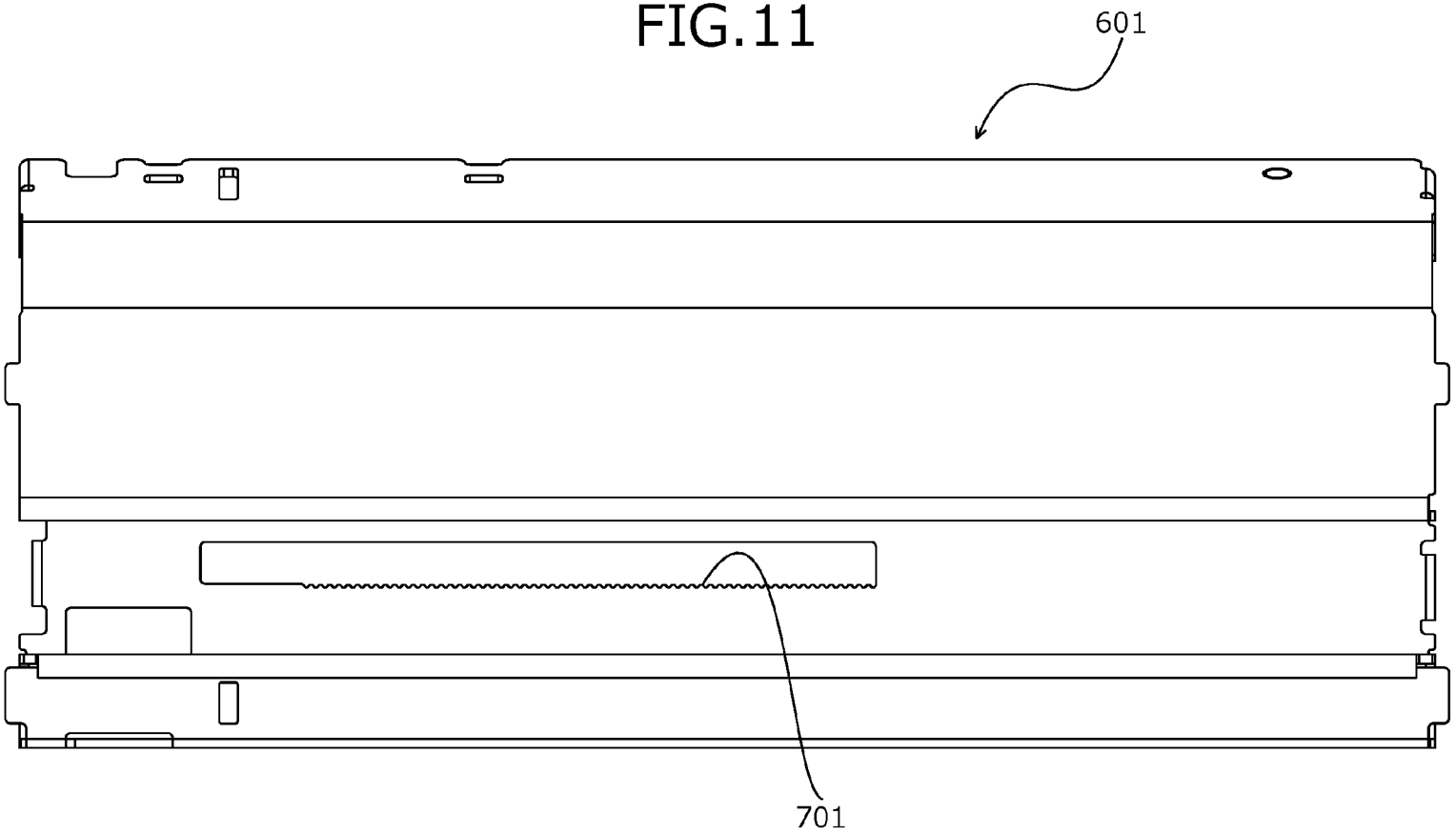
FIG. 11 is an explanatory view (part 4) of units making up the printing mechanism unit.

The guide unit 701 disposed on the main frame 601 forms a wave shape having protruding portions (crests) and receding portions (troughs) alternately appearing along the width direction of the printer 100 (see FIGS. 10 and 11). The diameter of the wire-like member forming the sensor spring 608 is preferably smaller than the dimension of the opening width of the receding portions in the wave shape of the guide unit 701. This enables the sensor spring 608 to be assuredly positioned in the receding portion of the guide unit 701.

The main frame 601 is formed by sheet-metal working of a metal plate-shaped member. The guide unit 701 disposed in the main frame 601 is formed integrally with the main frame 601 by sheet-metal working of the same metal plate-shaped member as the main frame 601. As a result, precision can be ensured for the position of the protruding portions and the receding portions appearing in the wave shape of the guide unit 701, along the width direction of the printer 100.

Figure 12:
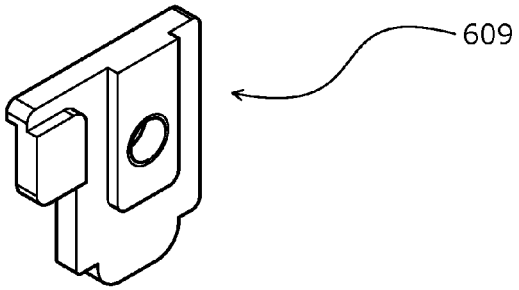
FIG. 12 is an explanatory view (part 5) of units making up the printing mechanism unit.
Figure 13:
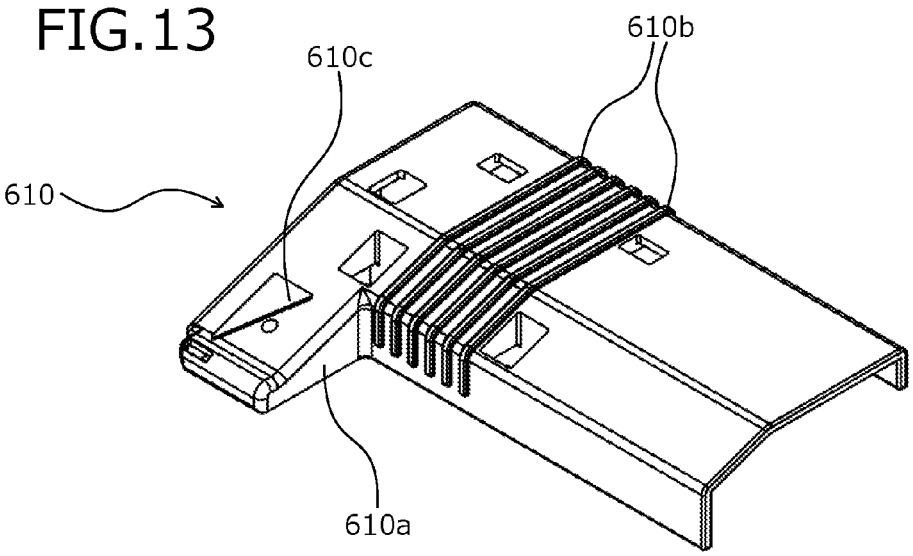
FIG. 13 is an explanatory view (part 6) of units making up the printing mechanism unit.
Figure 14:
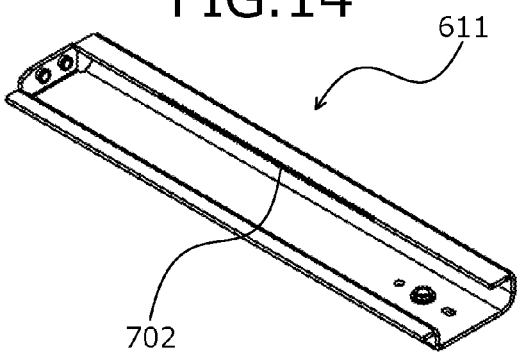
FIG. 14 is an explanatory view (part 7) of units making up the printing mechanism unit.
Figure 15:
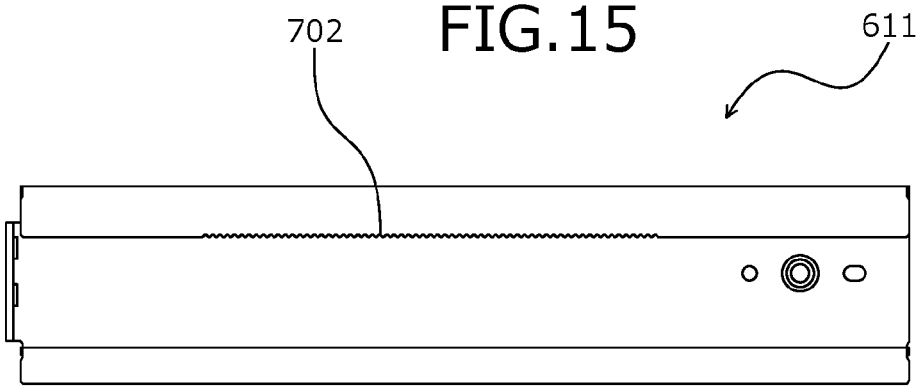
FIG. 15 is an explanatory view (part 8) of units making up the printing mechanism unit.

The lower sensor unit 603 includes an adjuster plate 609 that fixes the position of the sensor spring 608 relative to the lower sensor holder 605 (see FIG. 12). The adjuster plate 609 is fixed by a screw to the lower sensor unit 603 to sandwich the sensor spring 608 with one inner wall surface of the lower sensor unit 603, thereby fixing the position of the sensor spring 608 relative to the lower sensor holder 605.

The upper sensor unit 604 includes an upper sensor holder 610. The lower surface side of the upper sensor holder 610 forms a concave shape penetrating the upper sensor holder 610 along the width direction of the printer 100 (see FIG. 13). The upper sensor holder 610 is fitted to a sensor frame 611 from above as viewed in FIG. 6 and the position of the upper sensor holder 610 is thereby fixed in the conveyance direction of the paper 201. The upper sensor holder 610 is fitted to enable sliding relative to the sensor frame 611, along the width direction of the printer 100.

The upper sensor holder 610 includes a sensor holding portion 610*a* that holds a transmission type optical sensor 612. The sensor holding portion 610*a* forms a concave shape opened downward and the transmission type optical sensor 612 is disposed inside the concave shape. The transmission type optical sensor 612 includes a light-receiving element that receives light from the reflection type optical sensor 607 in the lower sensor unit 603 (not depicted).

The transmission type optical sensor 612 is held by the upper sensor holder 610 and is thereby positioned at the same position along the conveyance direction of the paper 201 as the reflection type optical sensor 607. The upper surface of the upper sensor holder 610 is provided with multiple ribs 610*b* having a longitudinal direction that is the conveyance direction of the paper 201 for providing finger hooks when the upper sensor holder 610 is moved along the width direction of the printer 100 relative to the sensor frame 611.

The upper sensor holder 610 is provided with a guide 610*c* as a guide to indicate the position of the transmission type optical sensor 612. The guide 610*c* may be achieved by a three-dimensional rectangular shape integrally disposed at the time of molding or may be achieved by a seal or a paint, thereby enabling an easily understandable indication of the position of the transmission type optical sensor 612, which is not directly visible.

In the printer 100 of the present embodiment, by using one end side of the upper sensor unit 604 along the width direction of the printer 100 as a fulcrum, the upper sensor unit 604 is disposed rotatably in directions causing the other end side of the upper sensor unit 604 to come into contact with and separate from the main frame 601. For example, the upper sensor unit 604 is disposed rotatably in the contacting and separating directions with respect to the main frame 601 by rotatably fixing the sensor frame 611 to one side frame 602 among the side frames 602.

Figure 17:
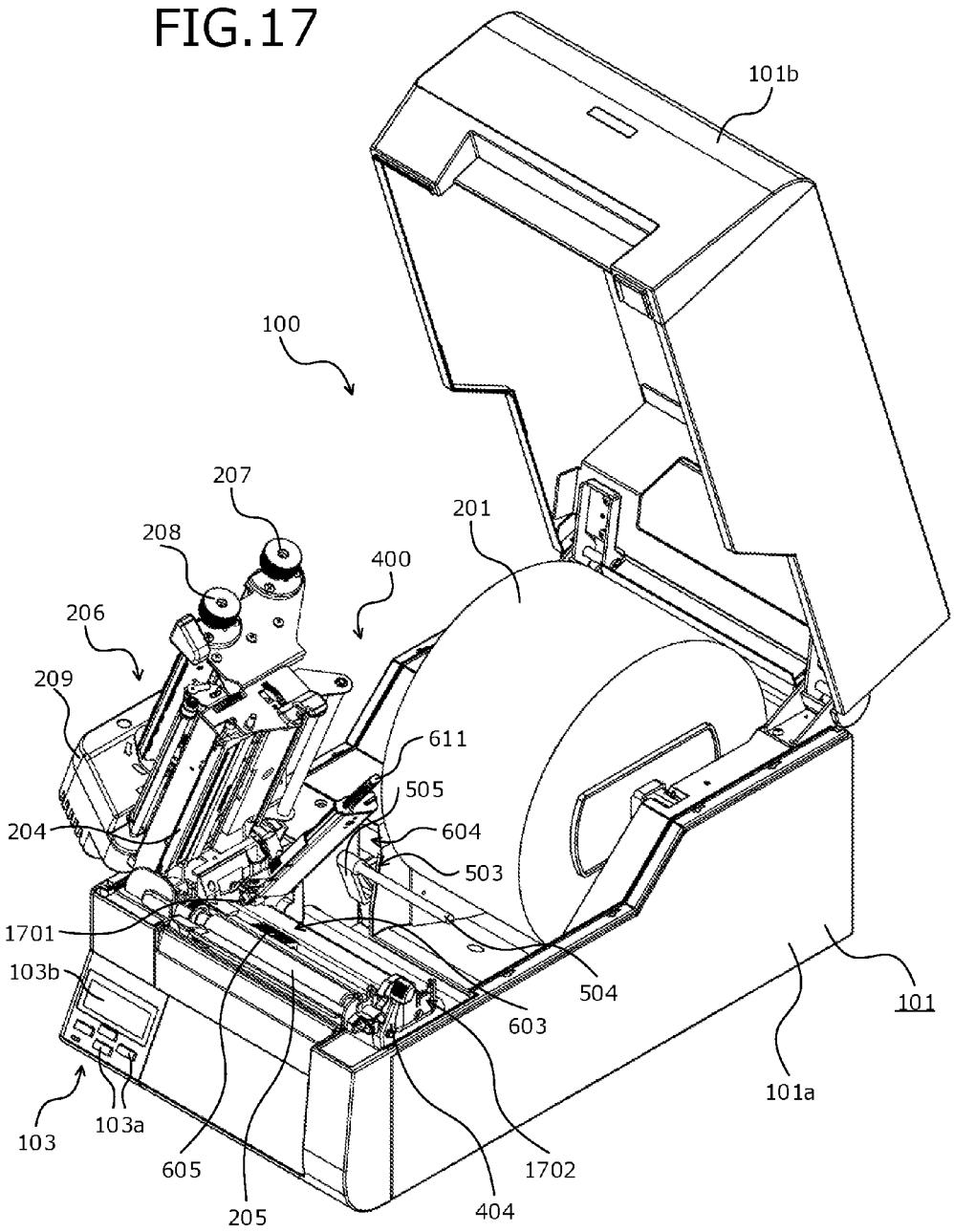
FIG. 17 is an explanatory view of the printer with a lower sensor unit opened to the outside.

In the printer 100, by using as a fulcrum a coupling position (see reference numeral 1701 in FIG. 17) between the one side frame 602 and the sensor frame 611 disposed on one end side along the width direction of the printer 100, the other end side of the sensor frame 611 can be rotated in the separating direction with respect to the main frame 601 to rotate the upper sensor unit 604 and open the lower sensor unit 603 to the outside (see FIG. 17).

The sensor frame 611 is formed by sheet-metal working of a metal plate-shaped member having a predetermined thickness. The sensor frame 611 includes a guide unit 702 forming a wave shape having protruding portions (crests) and receding portions (troughs) alternately appearing along the width direction of the printer 100 (see FIGS. 14 and 15). The guide unit 702 disposed on the sensor frame 611 is formed integrally with the sensor frame 611 by sheet-metal working of the same metal plate-shaped member as the sensor frame 611.

Figure 16:
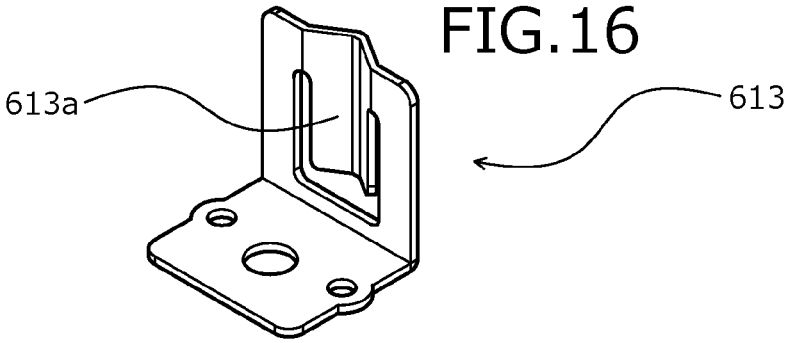
FIG. 16 is an explanatory view (part 9) of units making up the printing mechanism unit.

The upper sensor unit 604 includes a plate spring 613 implementing an elastic member (see FIG. 16). The plate spring 613 includes a protruding portion 613*a* forming substantially the same shape as the receding portions in the wave shape of the guide unit 702. The plate spring 613 is attached to the lower surface side of the upper sensor holder 610. The plate spring 613 is biased in the direction causing the protruding portion 613*a* to contact the guide unit 702 while being attached to the upper sensor holder 610. The plate spring 613 is formed by sheet-metal working of a metal plate-shaped member having a predetermined thickness that is thinner than the main frame 601 and the sensor frame 611.

The guide unit 701 disposed on the main frame 601 and the guide unit 702 disposed on the sensor frame 611 form the wave shapes that protrude and recede at the same positions along the width direction of the printer 100 when the upper sensor unit 604 is closed. In particular, the protruding portions of the wave shape of the guide unit 701 disposed on the main frame 601 and the protruding portions of the wave shape of the guide unit 702 disposed on the sensor frame 611 protrude at the same positions along the width direction of the printer 100, and the receding portions of the wave shape of the guide unit 701 disposed on the main frame 601 and the receding portions of the wave shape of the guide unit 702 disposed on the sensor frame 611 recede at the same positions along the width direction of the printer 100.

FIG. 17 is an explanatory view of the printer 100 with the lower sensor unit 603 opened to the outside. FIG. 17 depicts a state in which the upper housing 101*b* is rotated relative to the lower housing 101*a*, opening the inside of the housing 101 to the outside with the other end side of the sensor frame 611 rotated in the separating direction with respect to the main frame 601.

In FIG. 17, a holding unit 1702 is disposed on the other side frame 602 among the side frames 602 and different from the one side frame 602 coupled via the coupling position 1701 to one end of the sensor frame 611. When the upper sensor unit 604 is closed, the holding unit 1702 supports the other end of the sensor frame 611 coupled on the one end side to the one side frame 602. The other end of the sensor frame 611 is fitted to and held by the holding unit 1702. The holding unit 1702 supports the other end of the sensor frame 611 from the front and back surface sides of the printer 100 and from the lower side.

As described above, when the sensor frame 611 is rotated around the coupling position 1701 in the direction separating the lower sensor unit 603 and the upper sensor unit 604, the other end of the sensor frame 611 fitted to the holding unit 1702 is moved in the direction separating from the holding unit 1702 and, as a result, the lower sensor unit 603 can be opened to the outside. When the lower sensor unit 603 is opened to the outside, the lower sensor holder 605, i.e., the position of detection by the reflection type optical sensor 607 held by the lower sensor unit 603, can be moved along the width direction of the printer 100. The position of detection by the lower sensor unit 603 can be adjusted by sliding and moving the lower sensor holder 605 along the width direction of the printer 100 to an arbitrary position within a movement range of the reflection type optical sensor 607 held by the lower sensor holder 605.

An operator performing an operation of moving the position of detection by the lower sensor unit 603 first rotates the upper sensor unit 604 to separate the other end side of the upper sensor unit 604 from the main frame 601. As a result, the upper part of the main frame 601 is opened, which enables the operator to operate the lower sensor holder 605. The operator then grips the lower sensor holder 605 or presses the ribs 605*a* from above to move the lower sensor holder 605 along the width direction of the printer 100.

When an external force is applied to the lower sensor holder 605 along the width direction of the printer 100, the sensor spring 608 fitting in the guide unit 701 deforms along the wave shape in the compressing direction and climbs over the protruding portion adjacent to the receding portion of the fitting. The sensor spring 608 climbs over one protruding portion to fit into the adjacent receding portion.

As described above, the lower sensor unit 603 can limit the position of the reflection type optical sensor 607 to a position at which the sensor spring 608 fits in the receding portion of the wave shape and the position of the reflection type optical sensor 607 can be easily and accurately aligned along the width direction of the printer 100.

The lower sensor unit 603 can transmit a click feeling to the operator each time the sensor spring 608 climbs over one protruding portion. This click feeling enables the operator to move in an orthogonal direction, the lower sensor holder 605 based on the pitch of the wave shape and to easily and certainly position the lower sensor holder 605 at a desired position.

An operator performing an operation of moving the position of detection by the upper sensor unit 604 can move the position of detection by the upper sensor unit 604 in the closed state of the upper sensor unit 604 in the same way as the operation of moving the position of detection by the lower sensor unit 603. For example, the operator grips the upper sensor holder 610 or presses the ribs 610*b* from above to move the upper sensor holder 610 along the width direction of the printer 100.

When an external force is applied to the upper sensor holder 610 along the width direction of the printer 100, the protruding portion 613*a* of the plate spring 613 engaged the guide unit 702 deforms along the wave shape in the compressing direction and climbs over the protruding portion adjacent to the engaged receding portion. The protruding portion 613*a* climbing over one protruding portion engages with the adjacent receding portion. As described above, the upper sensor unit 604 can limit the position of the transmission type optical sensor 612 to positions at which the protruding portion 613*a* of the plate spring 613 engages with a receding portion of the wave shape and the position of the transmission type optical sensor 612 can be easily and accurately aligned along the width direction of the printer 100.

The upper sensor unit 604 can transmit a click feeling to the operator each time the protruding portion 613*a* of the plate spring 613 climbs over one protruding portion as is the case with the lower sensor unit 603. This click feeling enables the operator to move the upper sensor holder 610 based on the pitch of the wave shape along the width direction of the printer 100 and to easily and certainly position the upper sensor holder 610 at a desired position.

Since the protruding (crest) portions and the receding (trough) portions of the wave shapes formed by the guide unit 701 and the guide unit 702 arranged to oppose each other across the paper path are disposed at the same positions along the width direction of the printer 100, the positions of the reflection type optical sensor 607 and the transmission type optical sensor 612 moving independently of each other can be easily and accurately aligned along the width direction of the printer 100.

As described above, the printer 100 of the embodiment according to the present invention includes a paper path that guides the paper 201 used as a recording object through a predetermined path; the platen 205 implementing a conveyance mechanism that in a predetermined direction, conveys the paper 201 guided through the paper path; a pair of the sensor elements (the reflection type optical sensor 607 and the transmission type optical sensor 612) arranged to oppose each other across the paper path and to be movable along a direction (the width direction of the printer 100) orthogonal to the direction of conveyance of the paper 201 by the platen 205; and a recording unit (the print head and the platen 205) disposed on the paper path to perform a recording operation with respect to the paper conveyed through the paper path by the platen 205, based on a result of detection by the reflection type optical sensor 607 and the transmission type optical sensor 612.

In the printer 100 of the embodiment according to the present invention, the reflection type optical sensor 607 and the transmission type optical sensor 612 are interlinked with the guide unit 701 and the guide unit 702 via the sensor spring 608 and the plate spring 613 acting as the elastic members that are biased in the direction of coming into contact with the guide unit 701 and the guide unit 702, which are formed on the main frame 601 and the sensor frame 611 to form the wave shapes along the width direction of the printer 100, and the sensor spring 608 and the plate spring 613 elastically deform according to the wave shapes of the guide unit 701 and the guide unit 702.

In the printer 100 of the embodiment according to the present invention, the reflection type optical sensor 607 and the transmission type optical sensor 612 are disposed to be moveable along the guide unit 701 and the guide unit 702 by elastic deformation of the sensor spring 608 and the plate spring 613 according to position along the width direction of the printer 100.

In the printer 100 of the embodiment according to the present invention, the guide unit 701 corresponding to the reflection type optical sensor 607 and the guide unit 702 corresponding to the transmission type optical sensor 612 form the wave shapes protruding and receding at the same positions along the width direction of the printer 100.

According to the printer 100 of the embodiment of the present invention, by elastic deformation of the sensor spring 608 and the plate spring 613 consequent to the wave shapes of the guide unit 701 and the guide unit 702 according to the positions of the reflection type optical sensor 607 and the transmission type optical sensor 612 along the width direction of the printer 100 while the sensor spring 608 and the plate spring 613 are kept biased in the direction of coming into contact with the guide unit 701 and the guide unit 702, a click feeling can be transmitted to an operator each time the sensor spring 608 and the plate spring 613 climb over a protruding portion of the wave shapes, and the reflection type optical sensor 607 and the transmission type optical sensor 612 can be moved based on the pitch of the wave shapes along the width direction of the printer 100.

As a result, the positions of the reflection type optical sensor 607 and the transmission type optical sensor 612 can be limited to the positions at which the sensor spring 608 and the protruding portion 613*a* of the plate spring 613 engage with the receding portions of the wave shapes, and the positions of the reflection type optical sensor 607 and the transmission type optical sensor 612 formed as separate bodies can be easily and accurately aligned along the width direction of the printer 100.

According to the printer 100 of the embodiment of the present invention, the lower sensor holder 605 holding the reflection type optical sensor 607 and the upper sensor holder 610 holding the transmission type optical sensor 612 are moved along the guide unit 701 and the guide unit 702 formed on the main frame 601 and the sensor frame 611 and therefore, the positional accuracy of the reflection type optical sensor 607 and the transmission type optical sensor 612 can be ensured for the position of conveyance by the platen 205 and the position of recording by the recording unit.

According to the printer 100 of the embodiment of the present invention, the reflection type optical sensor 607 and the transmission type optical sensor 612 are coupled to the main frame 601 and the sensor frame 611 via the sensor spring 608 and the plate spring 613 biased in the direction of coming into contact with the guide unit 701 and the guide unit 702 and therefore, even if the printer 100 vibrates due to a conveyance operation by the platen 205 and the recording operation by the recording unit, the reflection type optical sensor 607 and the transmission type optical sensor 612 can be prevented from being displaced relative to the main frame 601 and the sensor frame 611.

According to the printer 100 of the embodiment of the present invention, since the protruding (crest) portions and the receding (trough) portions of the wave shapes formed by the guide unit 701 and the guide unit 702 arranged to oppose each other across the paper path are disposed at the same positions along the width direction of the printer 100, the positions of the reflection type optical sensor 607 and the transmission type optical sensor 612 moving independently of each other can easily and accurately be aligned along the width direction of the printer 100.

The printer 100 of the embodiment of the present invention is characterized in that the main frame 601 and the sensor frame 611 are formed by sheet-metal working of a metal plate-shaped member and in that the guide unit 701 and the guide unit 702 are formed integrally with the main frame 601 and the sensor frame 611, respectively.

According to the printer 100 of the embodiment of the present invention, the guide unit 701 and the guide unit 702 are formed integrally with the main frame 601 and the sensor frame 611 by sheet-metal working and therefore, the positions of the reflection type optical sensor 607 and the transmission type optical sensor 612 formed as separate bodies can be easily and accurately aligned along the width direction of the printer 100.

The printer 100 of the embodiment of the present invention is characterized in that the plate spring 613 includes the protruding portion 613*a* forming substantially the same shape as the receding portions in the wave shape. According to the printer 100 of the embodiment of the present invention, the elastic member, which assuredly engages with the receding portion of the guide unit 702, can be achieved with a simple configuration. As a result, the position of the transmission type optical sensor 612 can be fixed assuredly along the width direction of the printer 100.

The printer 100 of the embodiment of the present invention is characterized in that the sensor spring 608 is a wire spring formed of a wire-like member having a diameter dimension that is smaller than the dimension of the opening width of the receding portions in the wave shape.

According to the printer 100 of the embodiment of the present invention, the elastic member, which assuredly engages with the receding portion of the guide unit 701, can be achieved with a simple configuration. As a result, the position of the reflection type sensor can be fixed assuredly along the width direction of the printer 100.

According to the printer 100 of the embodiment of the present invention, a weight reduction can be achieved in the lower sensor unit 603 by implementing the sensor spring 608 by a wire spring.

INDUSTRIAL APPLICABILITY

As described above, the printer according to the present invention is applicable to a printer that uses, as a recording object, multiple types of paper sheets in which a portion to be detected with respect to a reference position varies along the paper width direction and the printer is particularly suitable for a printer that detects a portion to be detected with respect to a reference position by using a sensor separated across a paper conveyance path.

EXPLANATIONS OF LETTERS OR NUMERALS

100 printer
201 paper
203 head unit
205 platen
410 printing mechanism
601 main frame
602 side frame
603 lower sensor unit
604 upper sensor unit
605 lower sensor holder
606 sensor shaft
607 reflection type optical sensor
608 sensor spring
610 upper sensor holder
610*a* sensor holding portion
611 sensor frame
612 transmission type optical sensor
613 plate spring
701 guide unit
702 guide unit

The invention claimed is:

1. A printer comprising:

a paper path that guides paper used as a recording object through a predetermined path;

a conveyance mechanism that in a predetermined direction, conveys the paper guided through the paper path;

a sensor that includes a pair of sensor elements arranged to oppose each other across the paper path and to be movable along a direction orthogonal to a direction of conveyance of the paper by the conveyance mechanism; and a recording unit disposed on the paper path to perform a recording operation with respect the paper conveyed through the paper path by the conveyance mechanism, based on a result of detection by the sensor, wherein the sensor elements in the sensor are respectively interlinked with a guide unit via an elastic member biased in a direction of coming into contact with the guide unit that forms a wave shape along the orthogonal direction and is formed on a frame supporting the conveyance mechanism and the recording unit, the elastic member elastically deforming according to the wave shape of the guide unit, the sensor elements are disposed to be moveable along the guide unit by elastic deformation of the elastic member according to position along the orthogonal direction, the guide unit corresponding to one sensor element of the sensor and the guide unit corresponding to another sensor element of the sensor respectively form the wave shape protruding and receding at same positions along the orthogonal direction.

2. The printer according to claim 1, wherein the frame is formed by sheet-metal working of a metal plate-shaped member, and the guide unit is formed integrally with the frame.

3. The printer according to claim 2, wherein the elastic member is a plate spring having a protruding portion forming substantially a same shape as a receding portion of the wave shape.

4. The printer according to claim 2, wherein the elastic member is a wire spring formed of a wire-like member having a diameter dimension that is smaller than a dimension of an opening width of a receding portion in the wave shape.

5. The printer according to claim 1, wherein the elastic member is a plate spring having a protruding portion forming substantially a same shape as a receding portion of the wave shape.

6. The printer according to claim 1, wherein the elastic member is a wire spring formed of a wire-like member having a diameter dimension that is smaller than a dimension of an opening width of a receding portion in the wave shape.

* * * * *